US008196919B2

(12) United States Patent
Copestake et al.

(10) Patent No.: US 8,196,919 B2
(45) Date of Patent: Jun. 12, 2012

(54) LOCK MECHANISM

(75) Inventors: Steven Copestake, Southsea (GB); Steven Michael Hosking, Waterlooville (GB); Fiona Joan Mancini, Waterlooville (GB)

(73) Assignee: Talaris Holdings Limited, Basingstoke (GB)

( * ) Notice: Subject to any disclaimer, the term of this patent is extended or adjusted under 35 U.S.C. 154(b) by 57 days.

(21) Appl. No.: 12/866,988

(22) PCT Filed: Feb. 19, 2009

(86) PCT No.: PCT/GB2009/000419

§ 371 (c)(1),
(2), (4) Date: Nov. 1, 2010

(87) PCT Pub. No.: WO2009/103954

PCT Pub. Date: Aug. 27, 2009

(65) Prior Publication Data

US 2011/0067463 A1 Mar. 24, 2011

(30) Foreign Application Priority Data

Feb. 19, 2008 (WO) ..... PCT/GB2008/000570

(51) Int. Cl.
*B65H 1/00* (2006.01)

(52) U.S. Cl. ..... 271/145; 70/63; 70/158; 70/159; 70/160; 70/161; 70/162; 70/491; 109/23; 24/45; 24/46; 24/47; 24/59 R; 220/810; 220/811; 220/812; 220/813

(58) Field of Classification Search ..... 271/145, 271/3.01, 3.14; 70/63, 158–162, 491; 109/23; 24/45–47, 59 R; 220/810–813
See application file for complete search history.

(56) References Cited

U.S. PATENT DOCUMENTS

| | | | | |
|---|---|---|---|---|
| 3,961,507 | A | 6/1976 | Falk | |
| 4,275,667 | A * | 6/1981 | Hilton | 109/44 |
| 4,529,119 | A | 7/1985 | Granzow et al. | |
| 5,071,032 | A * | 12/1991 | Thornton et al. | 221/154 |
| 2005/0257584 | A1 | 11/2005 | Tseng | |
| 2009/0199607 | A1 * | 8/2009 | Huang | 70/491 |

FOREIGN PATENT DOCUMENTS

WO WO2007016091 2/2007

* cited by examiner

*Primary Examiner* — Kaitlin Joerger
*Assistant Examiner* — Prasad Gokhale
(74) *Attorney, Agent, or Firm* — Boyle Fredrickson, S.C.

(57) ABSTRACT

A lock mechanism is disclosed for a sheet store adapted for the dispensing or accepting of sheets. The sheet store comprises a container having a lid operable for access to the interior of the container and a shutter operable for the passage of sheets therethrough. The lock mechanism comprises: a locking plate movable relative to the container, the locking plate being operable to control a lid lock element and a shutter lock element; and an actuator arranged to control movement of the locking plate. The locking plate is movable between three positions, including: a closed position, in which the shutter lock element prevents opening of the shutter; a primed position, in which the shutter can be opened; and an open position which controls the lid lock element to permit opening of the lid.

11 Claims, 13 Drawing Sheets

LOCK MECHANISM

This application relates to lock mechanisms for sheet stores, for example cassettes for storing banknotes.

Sheet handling machines are in widespread use and include, for example, cash dispensers for dispensing quantities of banknotes either to bank tellers or directly to customers, and cash acceptors which allow users to deposit sums of money in the form of banknotes. In such apparatus, banknotes to be dispensed are typically stored in or more cassettes loaded into the dispenser which then selectively removes the correct quantity of banknotes from the cassettes in response to operator commands. Once a cassette has been emptied, or is running low on banknotes, it must be removed and replaced by a newly filled cassette. Typically, the replacement cassette will have been filled at another location and will then have been transported to the cash dispenser into which it is loaded. By carrying out the loading of the cassette in a remote location, security is increased.

Similarly, cash collectors include one or more stores, which may also be in the form of cassettes, into which accepted banknotes are fed. Once a cassette is full it must be removed from the apparatus and unloaded, which again is typically carried out at a separate location.

Typical cassettes comprise a container having an opening covered by a shutter through which sheets such as banknotes can pass when open (during either dispensing or accepting), and a lid which can be opened in order to load or unload the cassette. Commonly, the shutter is a slideable closure element, whereas the lid is hinged to the container. A cassette with this type of construction is disclosed for example in EP-A-0263680. The cassette is provided with a control means which is configured to open the shutter and unlock the lid upon insertion of the cassette into a store housing provided in the sheet handling apparatus.

For security reasons, it is important that banknotes inside the cassette cannot be accessed indiscriminately, either via the shutter or via the lid. The conventional cassette therefore includes locking means which prevent the lid or shutter being opened. The shutter mechanism can only be operated once a key has been turned which primes the locking means. When the cassette is inserted into the store housing, the control means engage probes in the store housing which open the shutter. This operation also disengages the lock holding the lid closed so that it may be opened by suitable means within the store housing.

However, this configuration leads to the problem that, when it is desired to open the lid to load or unload the cassette outside the sheet handling apparatus, it is not possible to do so without the use of a loading jig which acts a substitute for the probes located inside the store housing. The cassette is slid onto the loading jig which engages the control means to open the shutter and unlock the lid. As well as this being cumbersome, it increases the time needed to open the cassette and poses a real security risk since, especially where it is necessary to carry out loading/unloading of cassettes at a number of different locations, carrying a large loading jig between location marks the cash handling person out as an obvious target. Further, the cost of the jig adds to the overall cost of the cash handling system and it is not considered to greatly increase security since, should a cassette be stolen it would not be overly different for the thief to concoct their own version of the loading jig and/or to find more destructive ways of accessing the cash inside the cassette.

What is needed therefore is a locking mechanism which does not require a loading jig in order to unlock the cassette lid.

In accordance with a first aspect of the present invention, a lock mechanism is provided for a sheet store adapted for the dispensing or accepting of sheets, the sheet store comprising a container having a lid openable for access to the interior of the container and a shutter openable for the passage of sheets therethrough, the lock mechanism comprising:

a locking plate movable relative to the container, the locking plate being operable to control a lid lock element and a shutter lock element; and an actuator arranged to control movement of the locking plate;

wherein the locking plate is movable between three positions, including: a closed position, in which the shutter lock element prevents opening of the shutter; a primed position, in which the shutter can be opened; and an open position which controls the lid lock element to permit opening of the lid.

By arranging the locking plate to be moveable into a third position in which the lid lock element permits opening of the lid, it becomes possible to unlock the lid and therefore perform loading and unloading of the cassette, using only the actuator (which may, for example take the form of a lever or a key). There is no need for any loading jig and an additional advantage is that unlocking the lid is not dependent upon opening of the shutter: the shutter can remain closed during the loading/unloading operation.

It should be noted that the term "opening" of the shutter or lid implies opening from closed. That is, if the shutter is already partially open when the locking plate is moved to its closed position, it may be possible for the shutter to be opened further and, likewise, if the lid were already partially opened when the lid lock element returns to a locking position, it too may continue to be opened.

The lid lock element could form an integral part of the locking plate. However, it is preferable that the lock mechanism further comprises a latch member constituting the lid lock element, the latch member being movable between a locked position, in which the lid is locked in a closed configuration, and an unlocked position, in which the lid can be opened. This increases the freedom of design and makes it possible for the latch member to be additionally actuated by means other than the locking plate in certain embodiments, as will be discussed below.

Various mechanical arrangements could be implemented, however, preferably, the latch member is pivotably mounted relative to the container and arranged such that, in the open position, the locking plate abuts the latch member and pivots the latch member towards its unlocked position. This relatively simple design has been found to provide a robust solution. Advantageously, the lock mechanism further comprises a resilient element arranged to urge the latch member towards its locked position. Thus, in its default state, the lid will be locked.

Preferably, the lid lock element is adapted to engage, in a locked position, a feature provided on the lid to thereby lock the lid in a closed configuration. In a particularly preferred example, the lid lock element comprises a hook and a protrusion is provided on the lid to engage with the hook.

The shutter lock element could be formed integrally with the locking plate. However, it is preferable that the lock mechanism further comprises a stop member constituting the shutter lock element, the stop member being moveable between a locked position, in which opening of the shutter is prevented, and an unlocked position, in which the shutter can be opened. This allows for greater flexibility as regards the layout of shutter and locking plate.

Preferably, the stop member is slidably mounted relative to the container and coupled to the locking plate such that movement of the stop member between its locked and unlocked positions occurs substantially perpendicularly to the direction of motion of the locking plate. However, any suitable mechanical arrangement could be used and its selection will be dependent on the geometry of the cassette.

Advantageously, the stop member is coupled to the locking plate by a cam follower provided on one of the stop member and the locking plate, and a recess provided in the other, the recess including a cam for contacting the cam follower to cause relative motion substantially perpendicular to the direction of motion of the locking plate. This ensures a robust coupling between the two components resulting in reliable motion of the stop member. In some embodiments, the cam may include a notch for holding the stop member at a desired position/height.

Preferably, the lock mechanism further comprises a resilient member arranged to urge the stop member towards its locked position. In the default situation, the shutter is therefore prevented from opening.

Likewise, it is advantageous that the lock mechanism should further comprise a resilient member arranged to urge the locking plate towards its closed position.

Preferably, the lock mechanism further comprises control means responsive to the insertion and withdrawal of the sheet store to or from a store housing to, respectively, open or close the shutter. This enables the shutter to be automatically opened when the cassette is inserted into a sheet handling apparatus, and automatically closed on exit.

The control means could comprise any suitable mechanical configuration. However, it is preferable that the control means comprise a slide element coupled to the shutter for movement therewith, the shutter lock element being arranged, in a locked position, to obstruct motion of the slide element, and thereby prevent opening of the shutter.

Advantageously, the slide element comprises a first cam surface arranged to contact the stop member in its unlocked position thereby preventing any obstruction to the opening of the shutter caused by the stop member in its unlocked position.

The slide element may be coupled to the shutter by any suitable means. However, in a preferred embodiment, the control means further comprises a toothed gear wheel arranged to couple the slide element to the shutter, the slide element and the shutter each being provided with a rack gear arranged to engage the toothed gear wheel. Advantageously, the slide element is provided with a connector for coupling to an operating element provided in the store housing, to thereby cause sliding of the slide element on insertion and withdrawal of the sheet store to and from the store housing.

In a particularly preferred embodiment, the control means are additionally arranged to unlock or lock the lid upon, respectively, insertion and withdrawal of the sheet store to or from the store housing. This is useful where it is necessary to open the lid upon insertion of the sheet store into the store housing. This could be performed in a number of ways although it is preferable that the chosen technique should not depend upon the position of the locking plate.

Preferably, the slide element comprises a second cam surface which is arranged to abut a cam follower provided on the latch element and so pivot the latch member towards its unlocked position when the sheet store is inserted into the store housing. The first and second cam surfaces are preferably spaced from each other along the slide element in the slide direction.

In some implementations, a single lid lock element may be sufficient to securely lock the lid. However, in other cases it may be preferable to secure the lid at one or more additional points and therefore the lock mechanism advantageously further comprises a second lid lock element, spaced from the first and adapted to engage a second feature provided on the lid, wherein the second lid lock element is additionally controlled by the locking plate to permit opening of the lid when the locking plate is in the open position. Advantageously, the lock mechanism further comprises a second latch member constituting the second lid lock element, the second latch member being coupled to the first latch member for movement therewith.

As noted previously, the actuator can take a number of forms. Preferably, the actuator comprises a lever operable to move the locking plate between the closed, primed and open positions. In one preferred embodiment, the lock mechanism further comprises a handle for operation of the lever. The handle can be turned by a user without the need for a key (or similar) and is, therefore, more convenient. The handle can also be left in any desired position. For example, the handle may be left such that the lever holds the locking plate in its primed position, therefore allowing the shutter to be opened and closed more than once.

In another preferred embodiment, the lock mechanism further comprises a key operated lock cam and a key operated lock barrel for operation of the lever. This may be required for example where additional security is necessary and/or where a "single shot" system is preferred. Preferably, the key operated lock barrel is adapted such that a (conventional) key may only be removed when the lever is at a default position which does not constrain the locking plate from moving to its closed position. All other constraints removed, the locking plate will return to its closed position in which the shutter cannot be reopened. By a 'conventional' key, it is meant a key having a locating nib. Alternatively, the key operated lock barrel may be adapted such that the (conventional) key may additionally be removed when the lever is at a priming position in which the locking plate is constrained in its primed position. As in the case of the actuator comprising a handle, this makes it possible to configure the cassette for "multi-shot" use. As described below, it is also possible to configure a cassette having a conventional key operated lock barrel (i.e. one in which a conventional key can only be inserted/removed at one and the same position) by the use of a specially adapted key.

To improve security, it is preferable that the lock mechanism should further comprise a tamper seal arranged such that actuation of the actuator is evident from the tamper seal. This is particularly the case where a handle is used to operate the actuator in place of a key.

Preferably, the tamper seal comprises a rat tail or a padlock seal arranged such that the seal must be broken to allow actuation of the actuator.

In accordance with a second aspect of the invention, a lock mechanism is provided for a sheet store adapted for the dispensing or accepting of sheets, the sheet store comprising a container having a shutter operable for the passage of sheets therethrough, the lock mechanism comprising:

a locking plate movable relative to the container, the locking plate being operable to control a shutter lock element, and wherein the locking plate is movable between two positions, including: a closed position, in which the shutter lock element prevents opening of the shutter; and a primed position, in which the shutter can be opened;

an actuator arranged to control movement of the locking plate; and a de-priming device adapted to urge the locking plate towards its closed position upon opening of the shutter;

wherein the actuator is selectively configurable to be fixed at one of at least two positions, including a priming position, in which the actuator prevents the locking plate from returning to its closed position, and a default position, in which the locking plate is not prevented from returning to its closed position upon activation of the de-priming device.

The provision of an actuator which can be fixed at more than one position in this way increases the functionality of the cassette since the user can set the cassette to operate as a "single-shot" cassette or a "multi-shot" cassette by appropriate positioning of the actuator after priming.

Advantageously, the actuator comprises a key operated cam and a lock barrel from which a (conventional) key can be removed with the actuator fixed at either of the priming or default positions. Alternatively, a 'conventional' lock barrel could be used in conjunction with a specially adapted key, as described below.

In an alternative preferred embodiment, the actuator comprises a handle which can be operated by a user to fix the actuator at either of the priming or default positions.

Preferably, the configuration of the actuator is such that the action of the de-priming device is not sufficient to move the actuator from its priming position to the default position.

In certain preferred embodiments, the lock mechanism further comprises a tamper detect seal, for detection of any movement of the actuator from the default position to the priming position and/or from the priming position to the default position. This is particularly useful where the actuator comprises a handle rather than a key operated lock since it enhances security to a similar level. Preferably, the tamper detect seal comprises a tag connected between the actuator and the container, which must be broken in order to move the actuator.

In accordance with a third aspect of the invention, a lock mechanism is provided for a sheet store adapted for the dispensing or accepting of sheets, the sheet store comprising a container having a shutter operable for the passage of sheets therethrough, the lock mechanism comprising:

a locking plate movable relative to the container, the locking plate being operable to control a shutter lock element, and wherein the locking plate is movable between two positions, including: a closed position, in which the shutter lock element prevents opening of the shutter; and a primed position, in which the shutter can be opened; and an actuator arranged to control movement of the locking plate;

wherein the actuator comprises a handle which can be operated by a user for movement of the locking plate and a tamper-detect seal for detection of movement of the actuator.

The provision of a handle-operated actuator (rather than a lock) is found to be of great convenience since there is no requirement for a key. By a "handle", it is meant a component which can be gripped and moved by the user, to activate the lock mechanism without any intervening device. Preferably, the handle is permanently attached to the lock mechanism or cassette. The use of a tamper-detect seal enhances security by preventing indiscriminate resetting of the single shot action of the shutter (de-priming). As described above, in preferred embodiments, once the shutter has been opened and closed, the shutter lock prevents it from being re-opened until the mechanism is re-primed. However the mechanism cannot be re-primed without removing the seal, re-priming and then replacing the broken seal with another seal. Preferably, each tamper-detect seal is associated with a unique identifier, for example an ID code or number. This provides traceability which is something a key operated lock does not offer.

The invention further provides a sheet handling apparatus comprising a store housing adapted to receive a sheet store as described above, the store housing including an operating element for operating the control means of the sheet store, upon insertion and withdrawal of the sheet store to and from the store housing. Preferably, the operating element comprises a probe adapted to couple with the connector of the sheet store.

Advantageously, the sheet handling apparatus further comprises a lid opening device for opening the lid of the sheet store upon insertion of the sheet store to the store housing when the lid lock element is in its unlocked position.

A fourth aspect of the invention provides a locking system comprising a lock mechanism as described above, and a key, wherein the actuator of the lock mechanism comprises a key-operated lock barrel operable to be rotated between at least first and second positions, the key being adapted such that it can be inserted into, engage with, and be withdrawn from the key-operated lock barrel regardless of the rotational position of the key-operated lock barrel.

By arranging the key such that it can be inserted into and withdrawn from the lock when the lock is at any rotational position, it becomes possible to use a conventional lock barrel for both 'single shot' and 'multi shot' use.

The key can be inserted at a first position, e.g. corresponding to the 'locked' position, turned until the lock is in a second position, e.g. the 'primed' position, and then removed such that the lock remains in its second position—in this example, permanently primed for multi shot use. This is not possible using a conventional lock barrel and conventional key, since typically such keys include a protruding 'nib' for assisting in aligning the key with the lock and retaining the key within the lock once it has been turned. For instance, in the case of a tubular key, the nib is commonly provided towards the end of the tubular shank away from the key bow (used to grip the key), and extends radially outward from the outer surface of the tubular shank. A conventional tubular lock includes a recess adjacent the tubular keyway for receiving the nib and, when the (correct) key is inserted in this position, it will automatically be correctly aligned with the locking mechanism. However, once the conventional key is turned, rotating the lock away from its starting position, the nib prevents removal of the key since retaining means within the conventional lock obstruct the passage of the nib out of the lock barrel. The conventional key can therefore only be removed by returning the lock to its starting position such that the nib and recess are once more aligned. The key used in the present aspect of the invention does not include a nib such that it will not be retained by a conventional lock regardless of the position of the lock.

Preferably, the key-operated lock barrel comprises a tubular keyway and the key comprises a tubular shank, the shank of the key being inserted into the keyway in use.

Advantageously, the tubular shank of the key is provided with one or more circumferential cuts adapted to engage with corresponding protrusions in the tubular keyway.

The cuts act to distinguish one lock and key pair from another, such that the keys are not interchangeable between locks.

Preferably, the tubular shank of the key does not extend radially outward further that the radius of the tubular keyway of the lock. Such an arrangement ensures that the key can be inserted and removed without retention by the lock.

Examples of locking mechanisms in accordance with the present invention will now be described with reference to the accompanying Figures in which:

FIG. 1 schematically illustrates a first example of a sheet store for use with a first embodiment of the invention;

Figure 3:
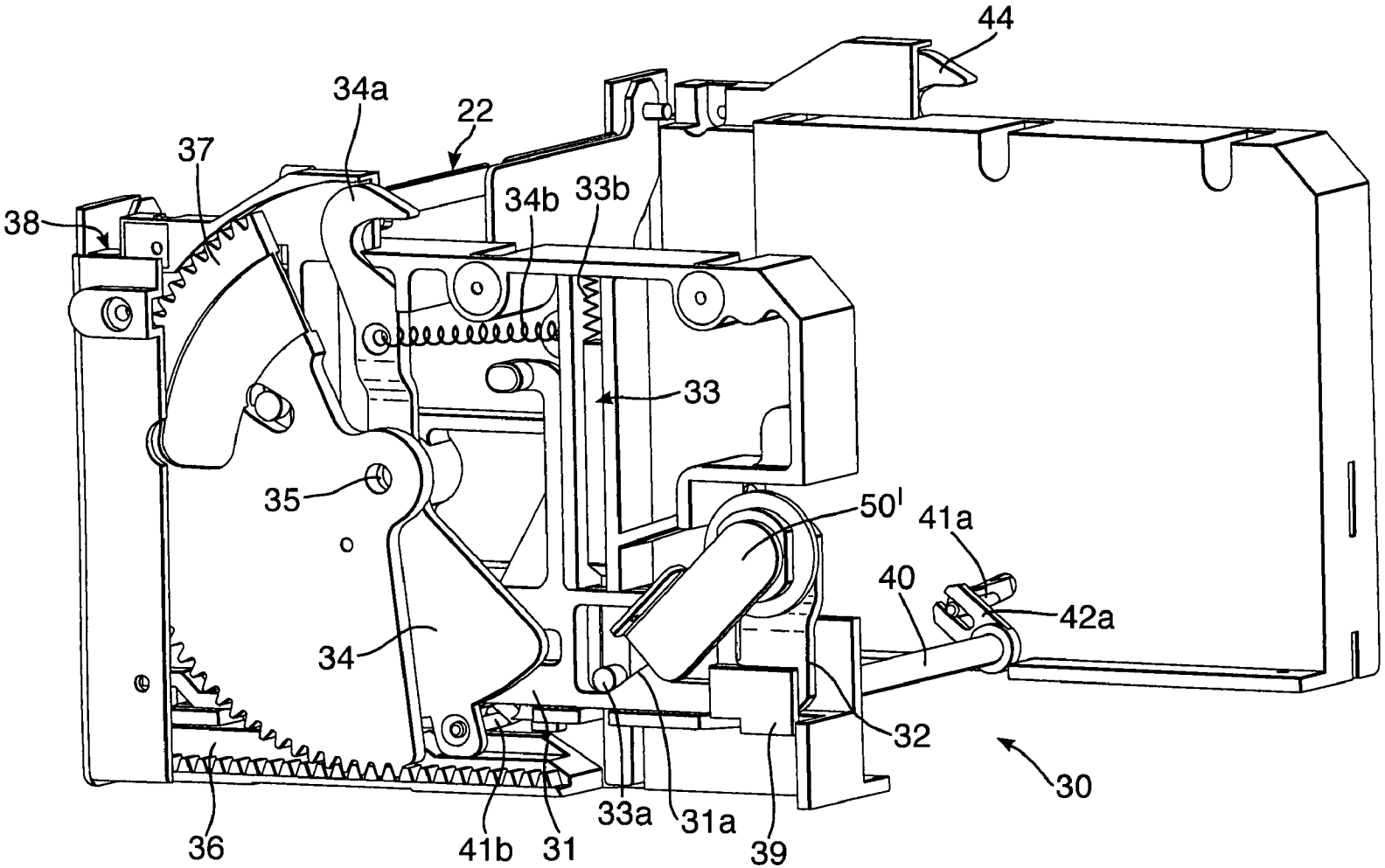
FIG. 3 depicts the second embodiment of a locking mechanism in a closed configuration.
Figure 3A:
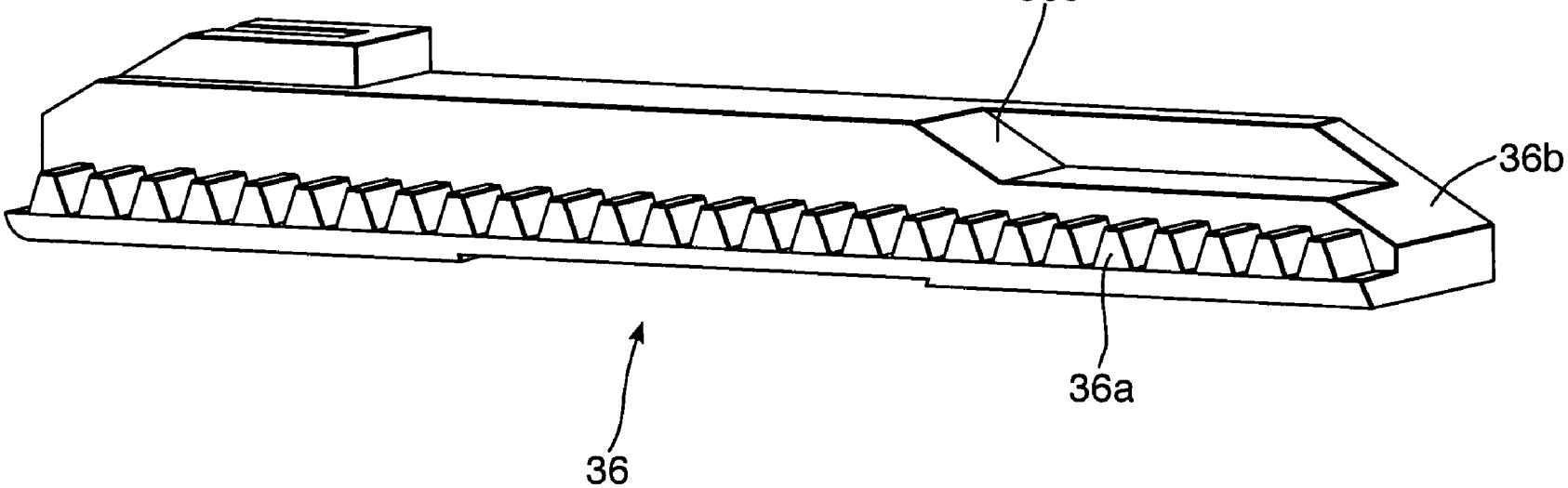
Figure 4:
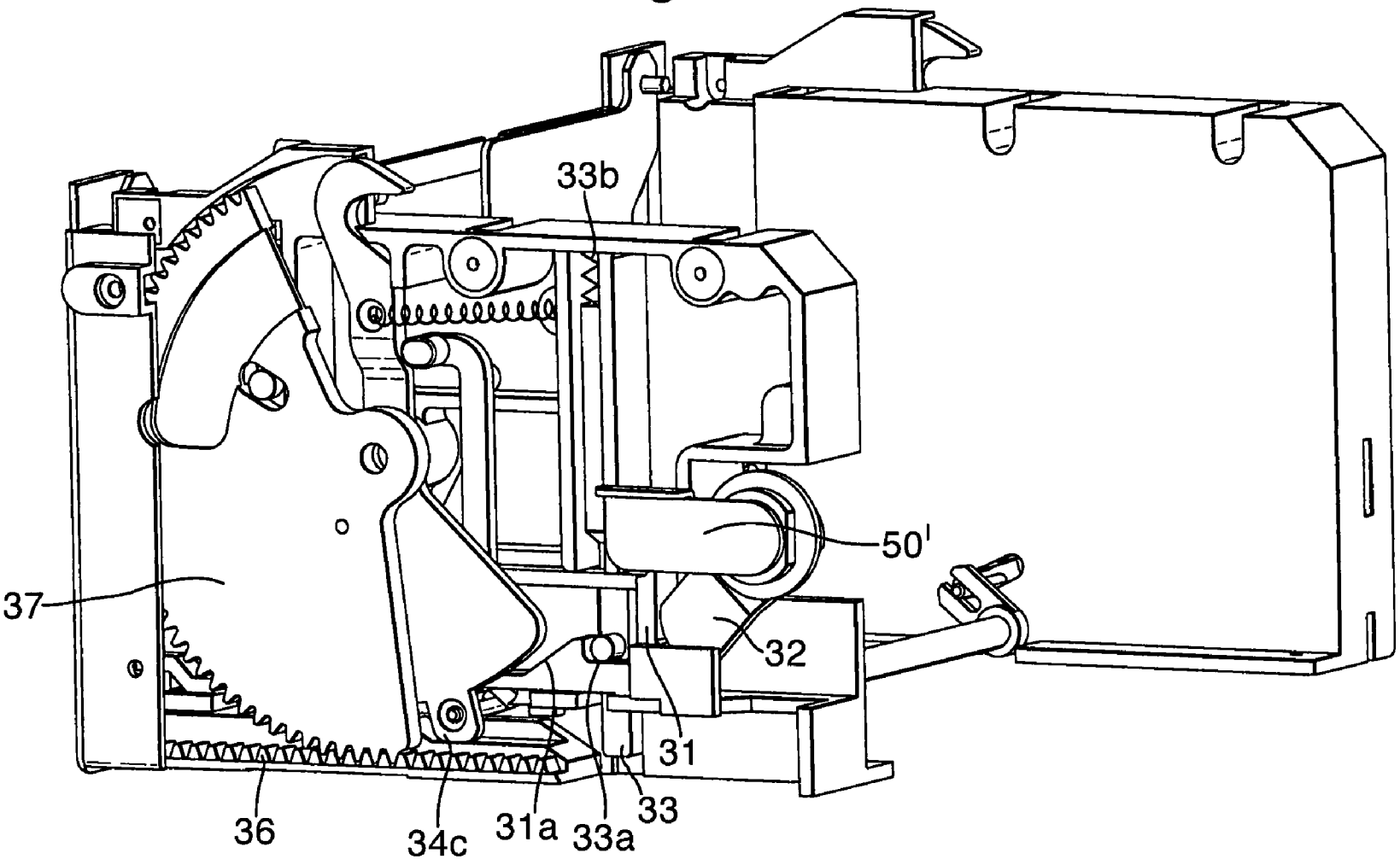
Figure 5:
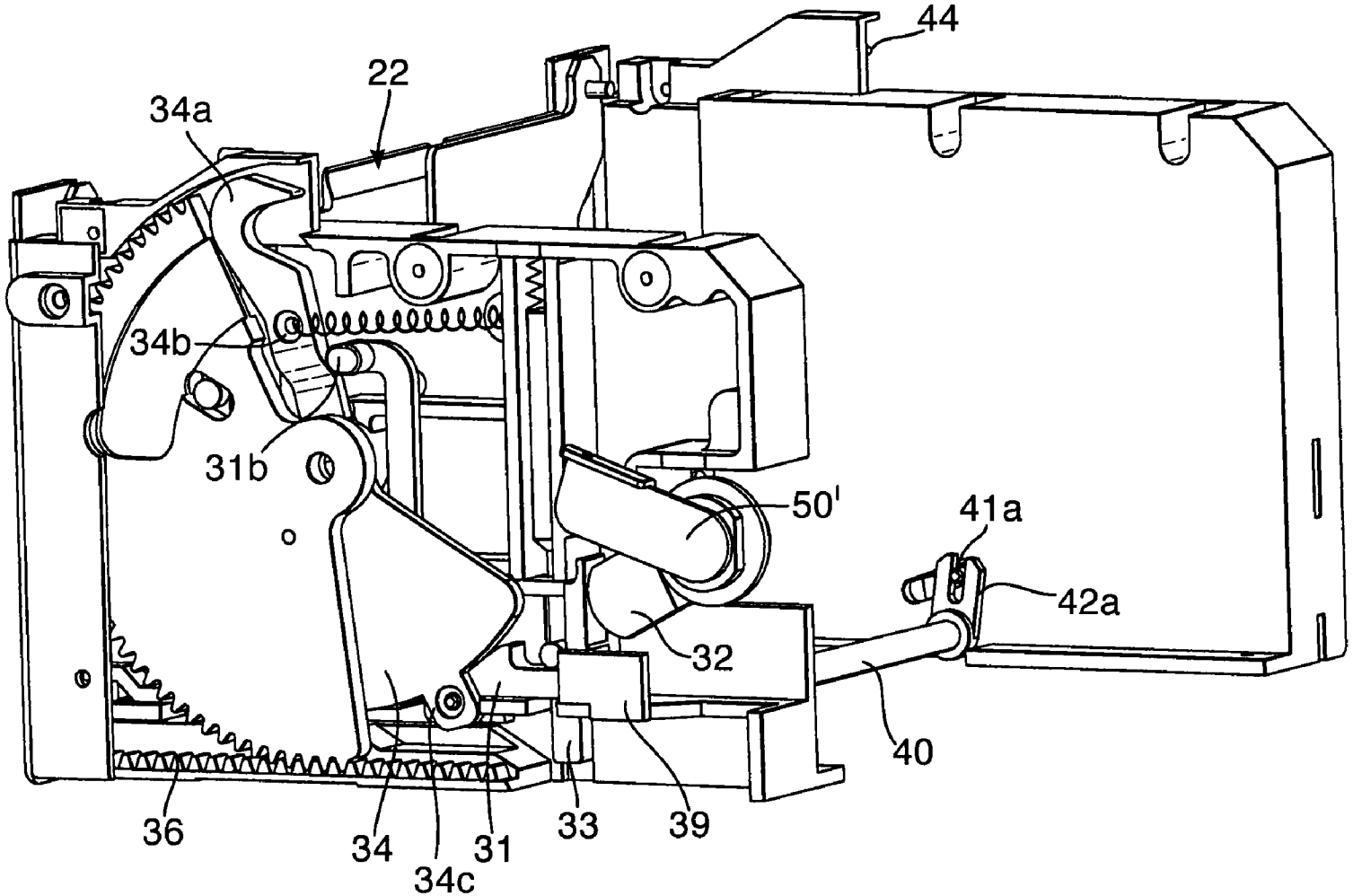
Figure 6:
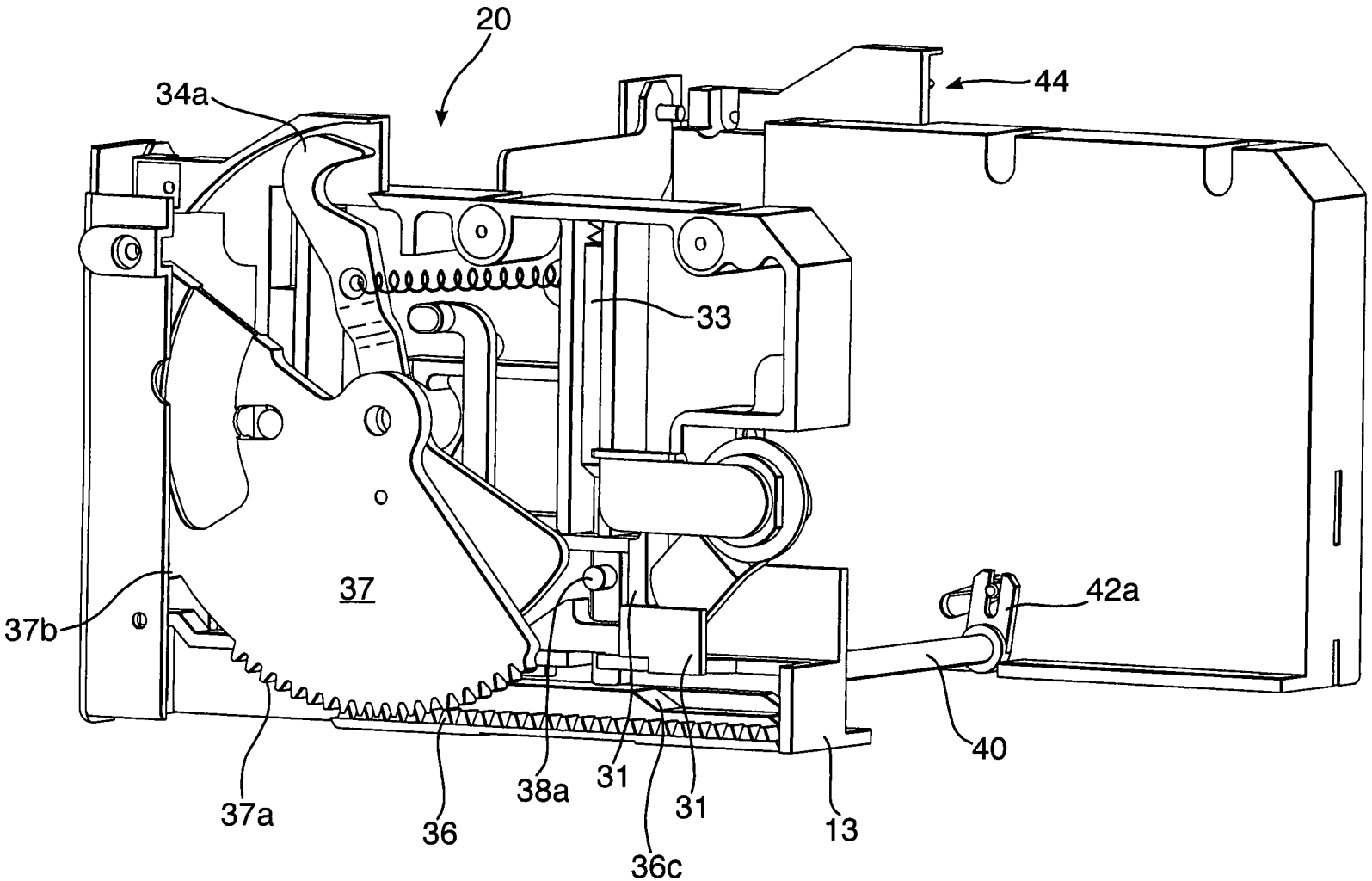
Figure 7:
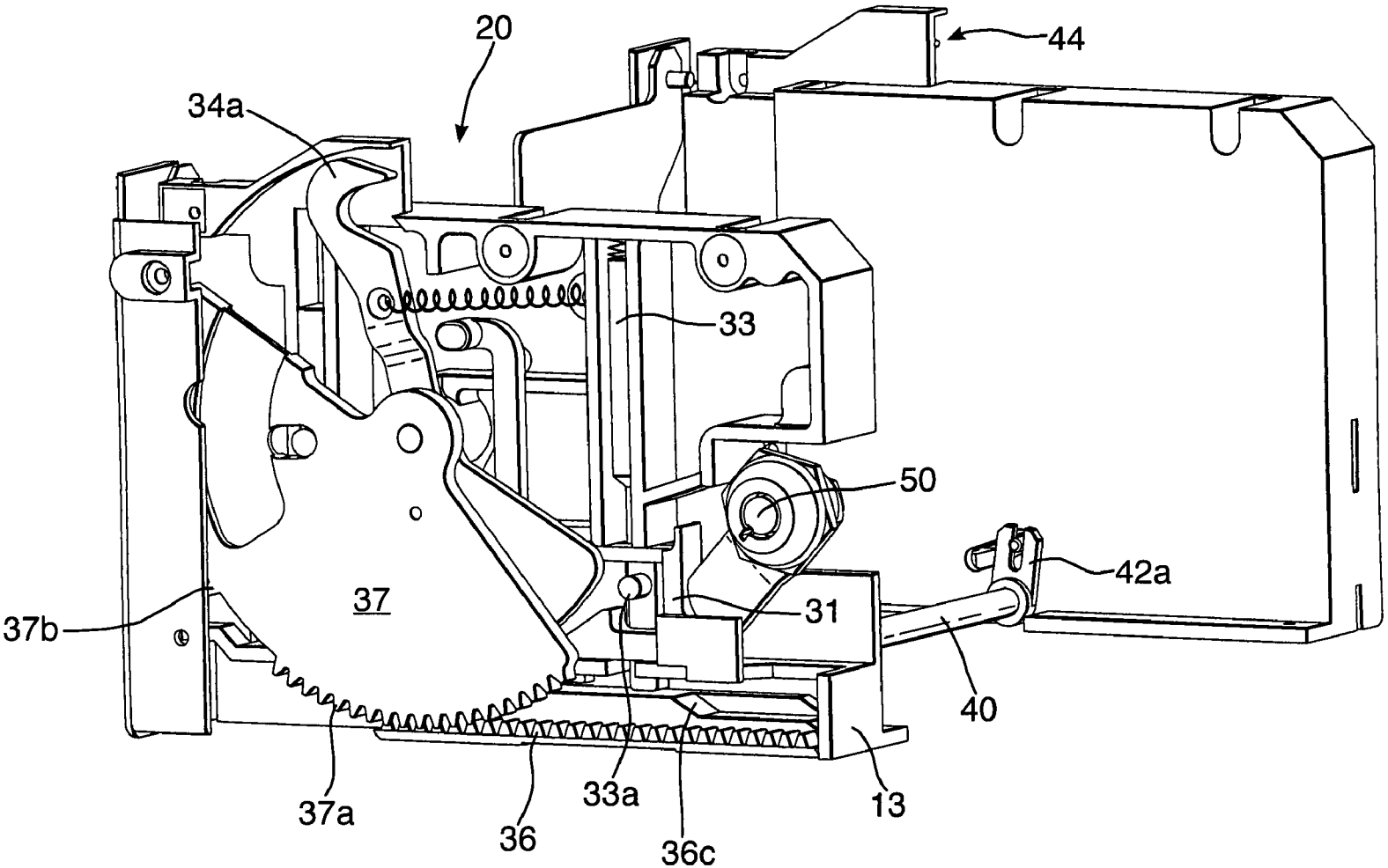
Figure 8:
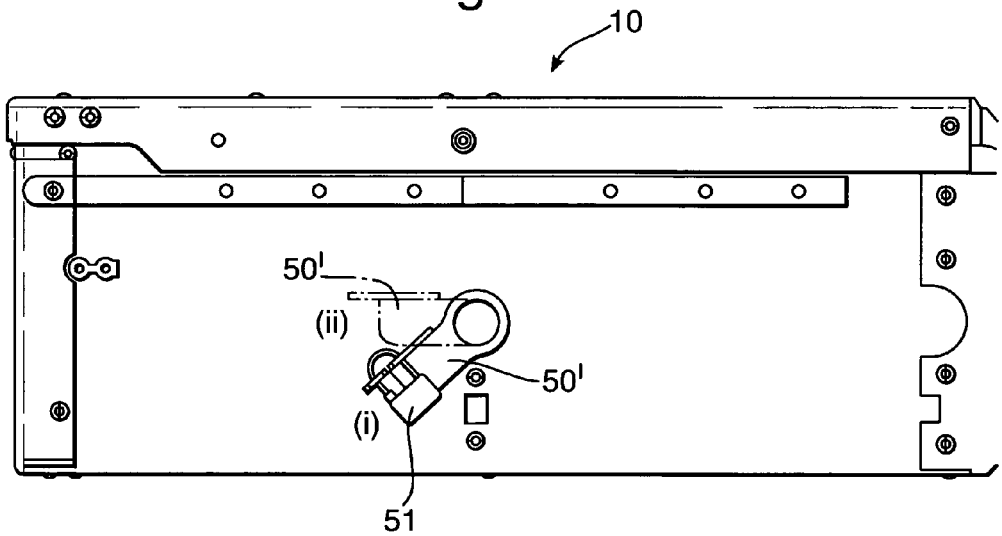
Figure 9:
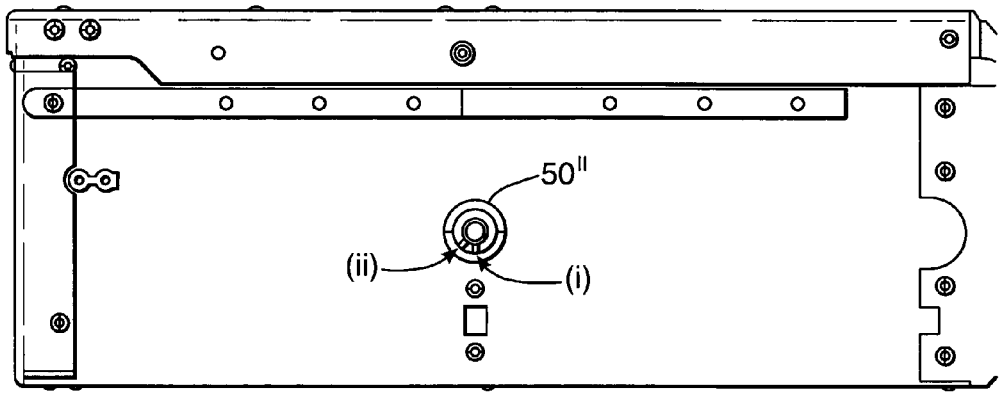
Figure 10:
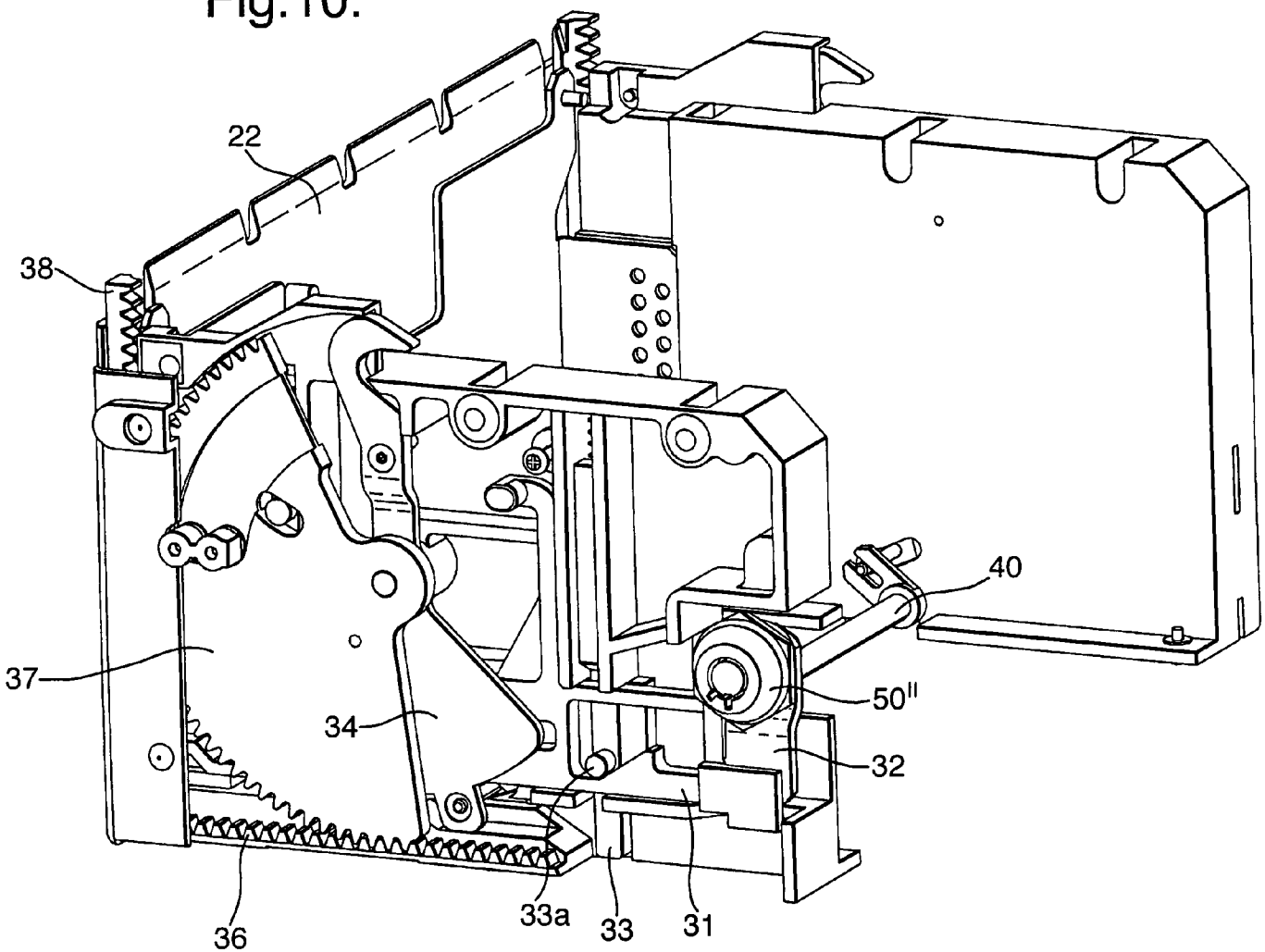
Figure 11A:
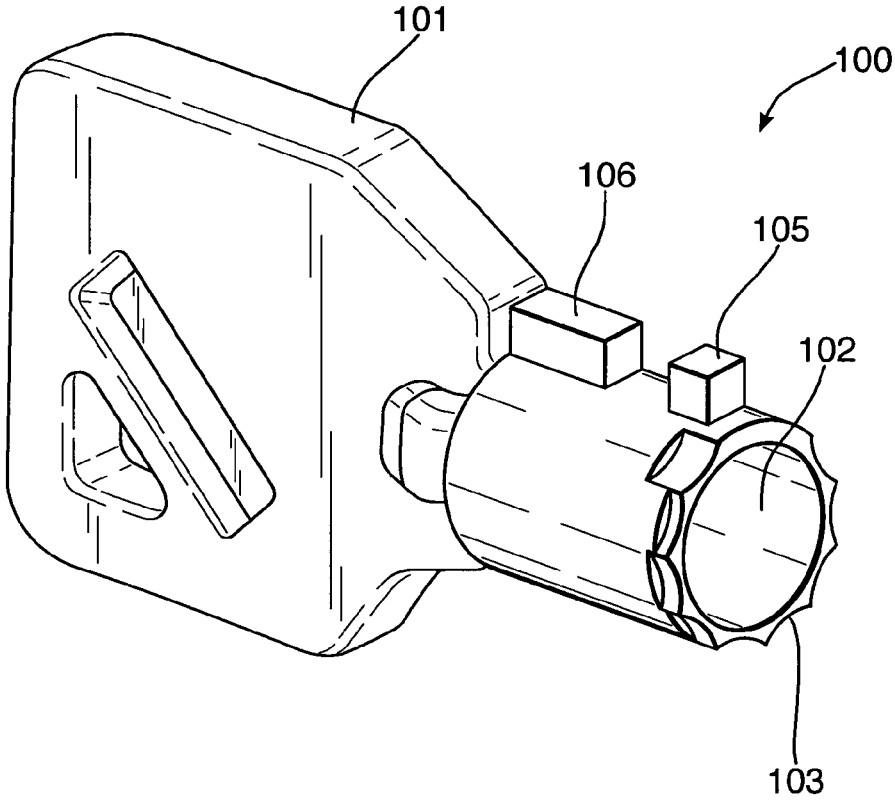
Figure 11B:
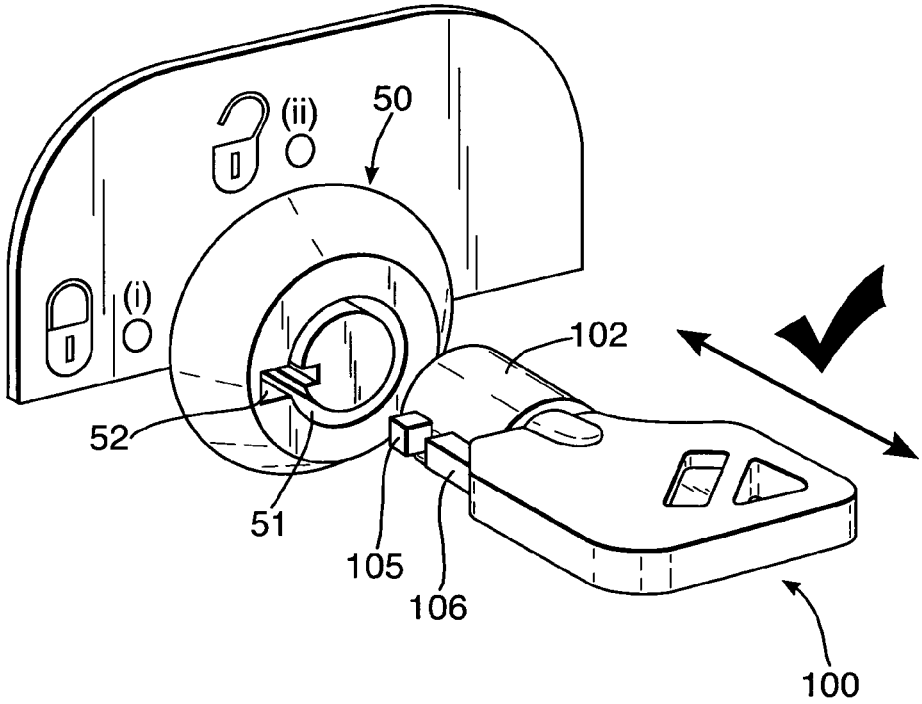
Figure 11C:
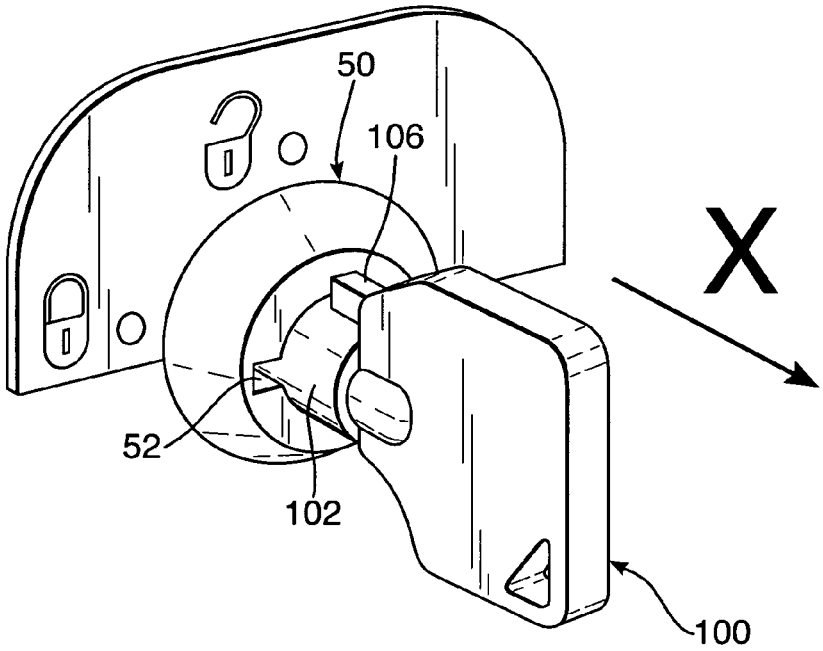
Figure 12A:
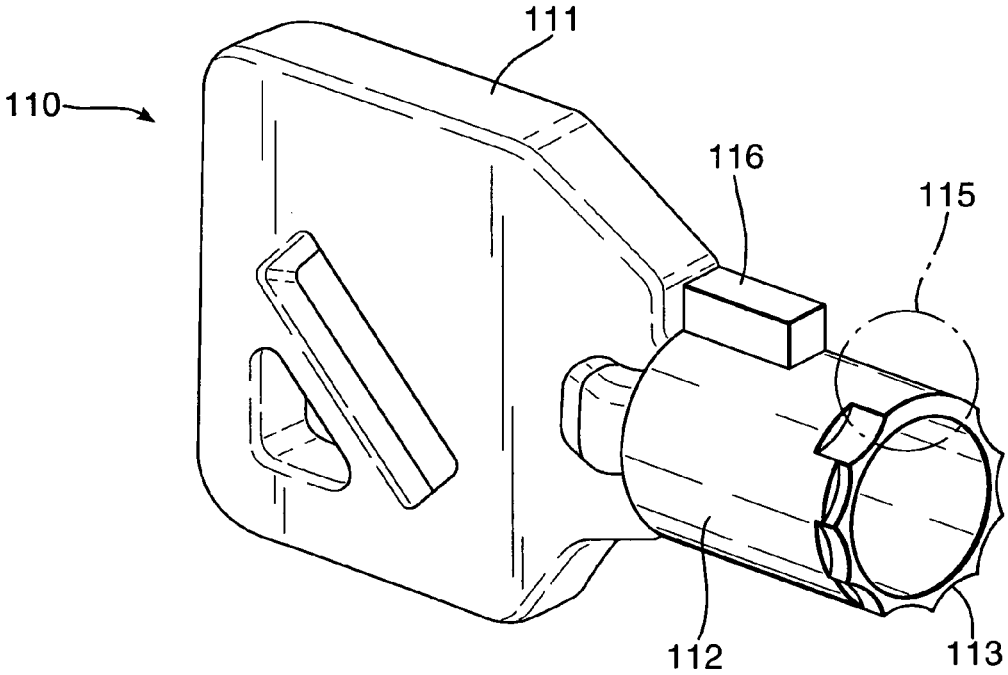
Figure 12B:
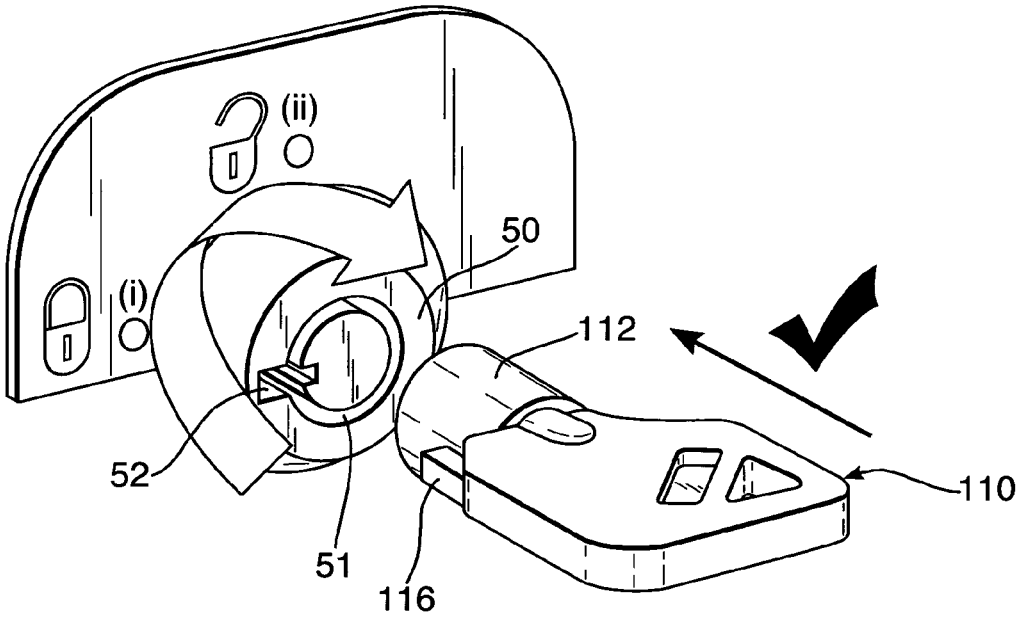
Figure 12C:
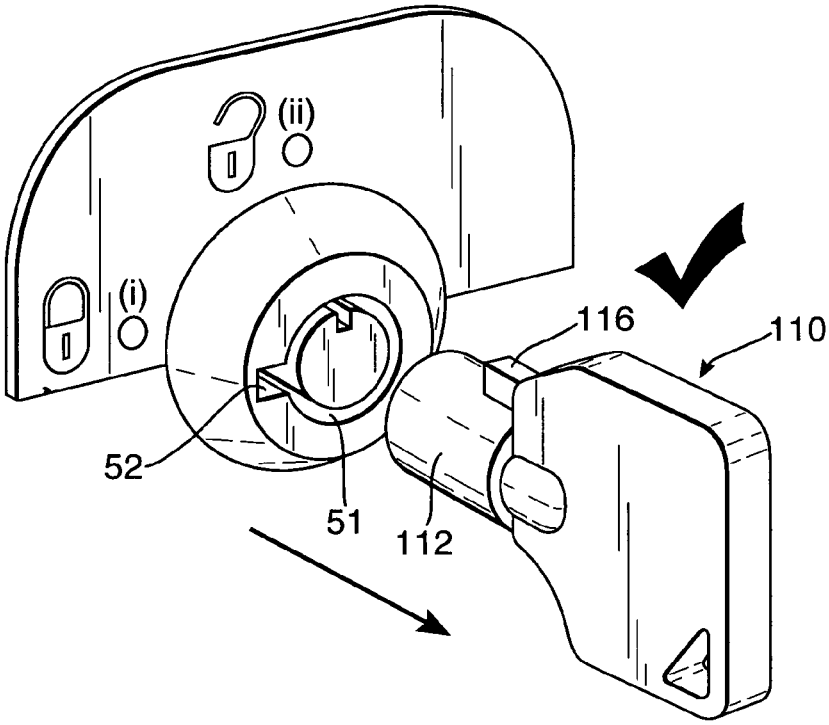

FIG. 3*a* shows an enlarged view of a portion of a slide element used in the second embodiment;

FIG. 4 depicts the second embodiment in a primed configuration;

FIG. 5 depicts the second embodiment in an open configuration;

FIG. 6 depicts the second embodiment in a shutter open configuration;

FIG. 7 shows the first embodiment of the invention in a shutter open configuration;

FIG. 8 shows the second example of a sheet store with the actuator in the (i) default position and (ii) priming position respectively, the latter shown in dotted lines;

FIG. 9 shows a third example of a sheet store for use with a third embodiment of the invention;

FIG. 10 shows the third embodiment of the invention in a closed configuration;

FIGS. 11 *a*), *b*) and *c*) show a lock barrel and key, and operations thereof; and FIGS. 12 *a*), *b*) and *c*) show a lock barrel and specially adapted key, and operation thereof.

The following examples will focus on sheet stores used to contain banknotes for dispensing and/or accepting apparatus. However, it will be appreciated that the invention is not limited in this regard and the store could be adapted to contain any sheet document. As such, the sheet store will typically be referred to as a cassette, although it will be appreciated that other containers may be equally suitable depending on the application.

Figure 1:
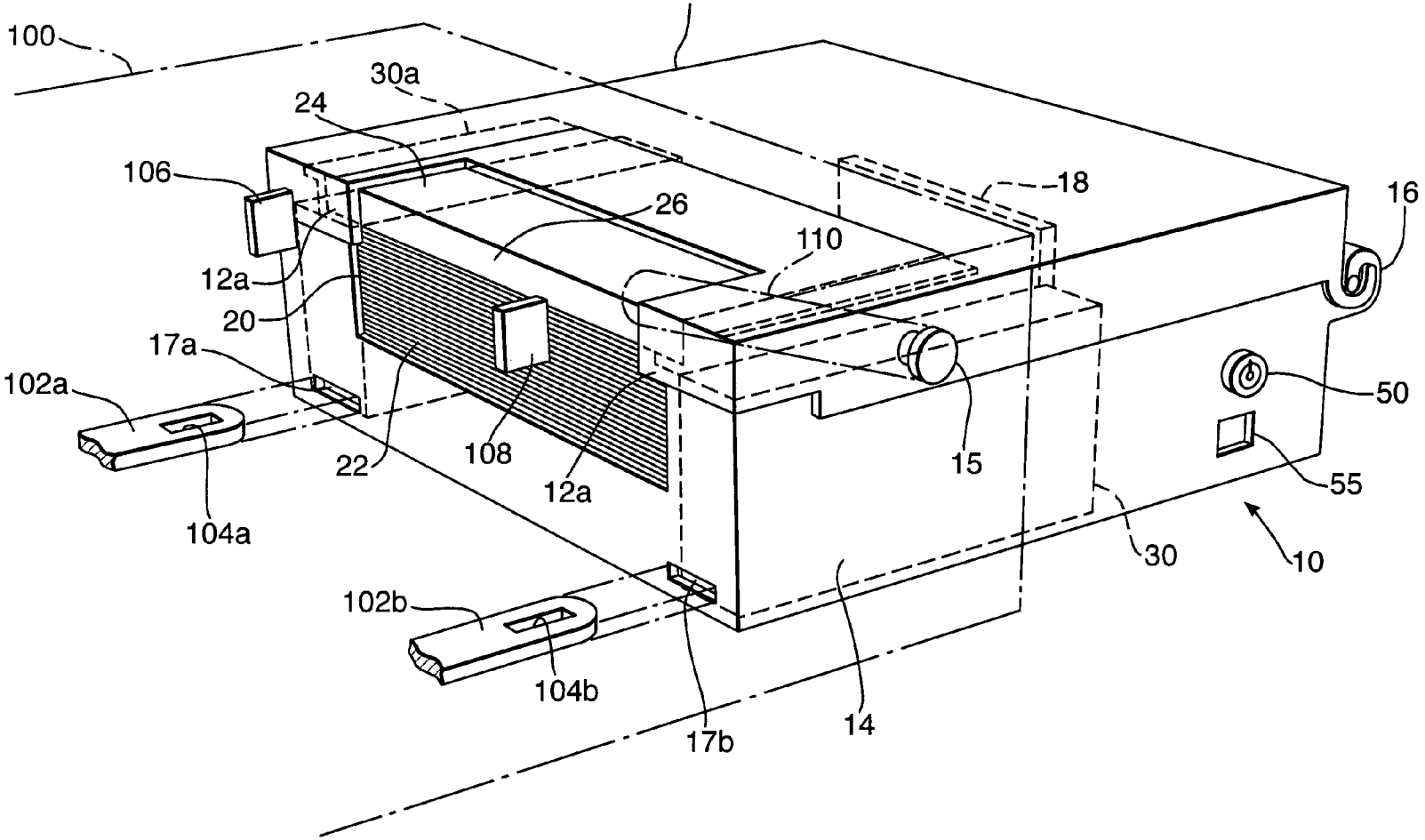
Figure 2:
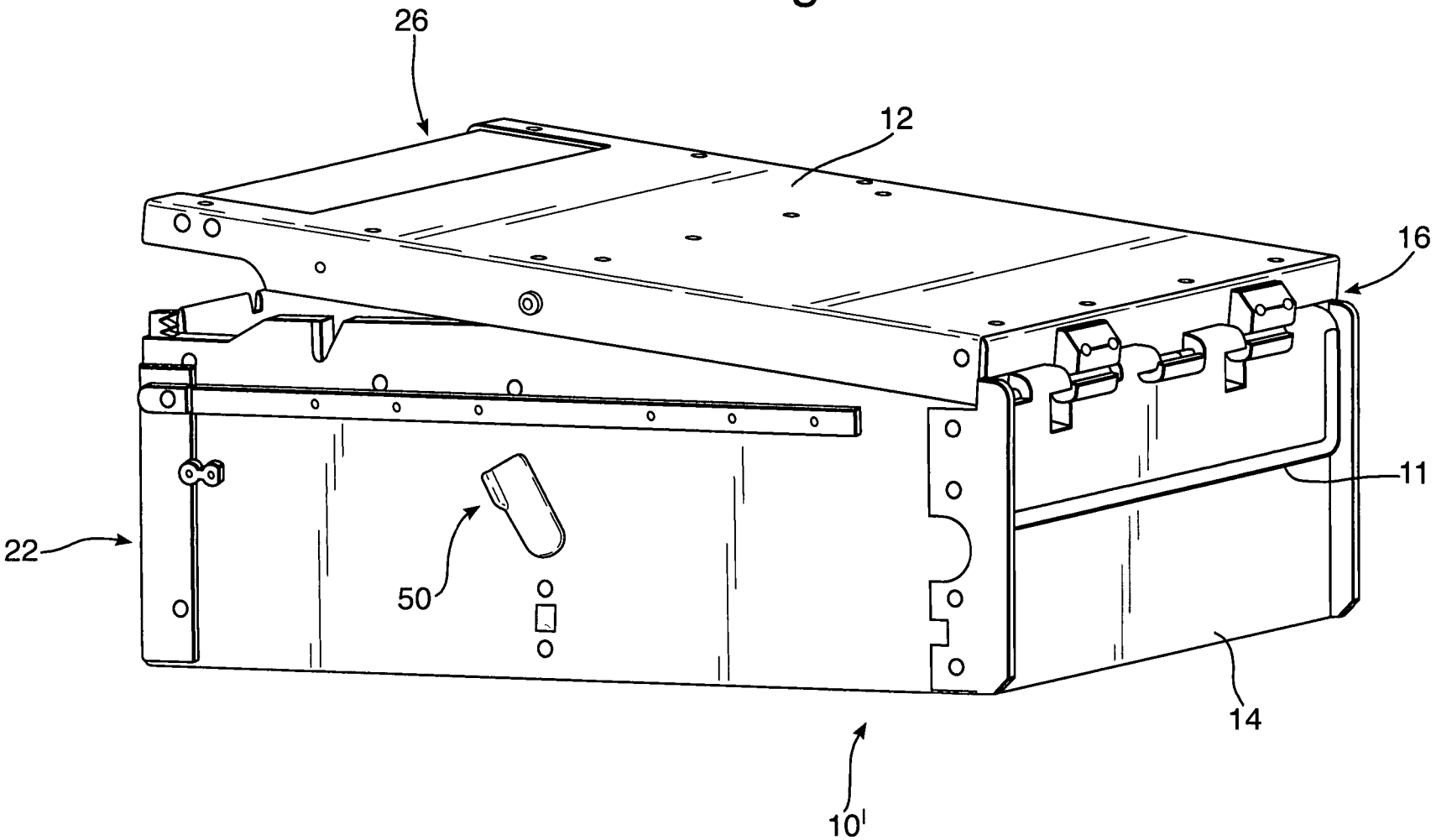
FIG. 2 shows a second example of a sheet store for use with a second embodiment of the present invention.

The cassettes shown in FIGS. 1 and 2 are suitable for use with first and second embodiments of the locking mechanism 30. The cassette 10 comprises a base 14 to which is attached a lid 12 via a hinge 60. In use, the cassette 10 is loaded with banknotes (not visible) and inserted into a store housing 100 which forms part of a sheet handling apparatus (not visible). Upon command from a user, the sheet handling apparatus removes notes from the cassette 10 and dispenses them to the customer. Notes exit the cassette 10 through an opening 20 in one end face of the base 14 which, when not in use, is closed by shutter 22. In this particular example, the cassette is further adapted to accept reject notes from the sheet handling apparatus which may occur, for example, if double banknotes are fed or if there is a jam. For this purpose, an opening 24 is provided in lid 12, closed when not in use by cover 26. Further, the lid 12 is arranged to be opened a small amount inside the store housing 100 which is achieved by the engagement of boss 15 provided on each side of the lid 12 with a slot 110 provided in the side of store housing 100. The slot 110 is angled such that, as the cassette 10 is slid into the store housing 100, the boss 15 follows the slot 110 upward and so lifts the lid.

FIG. 2 shows a second example of a cassette 10' for use with a second embodiment of the lock mechanism 30 in which the lid 12 is shown in an open position. Rejected notes enter the cassette through the aperture 24 in the raised lid 12.

The cassette 10' shown in FIG. 2 differs only from the cassette 10 shown in FIG. 1 by the use of a handle 50' in place of key operated lock 50. As will be described below, key operated lock 50 or handle 50' is used to actuate locking mechanism 30.

The cassettes also include a pusher plate 18 which, in use, is sprung against the loaded banknotes to urge them towards the shutter 22 for dispensing. A handle 11 may also be provided for assisting the user in carrying the cassette and withdrawing it from the store housing 100.

As shown in FIG. 1, the lock mechanism 30 is arranged in a side wall of the cassette 10. A duplicate locking mechanism 30*a* may be provided in the opposite wall of the cassette as shown in FIG. 1. However, in most cases it is sufficient to have a single locking mechanism 30 in one side of the cassette and only selected components in the other, as will be described below.

FIG. 3 shows the components making up the second embodiment of locking mechanism 30 in more detail. The components are mounted to an internal wall 13 of the cassette 10 which is machined or moulded to support the various components in the manners described below. A locking plate 31 is slideably mounted on the wall 13 in a manner which permits movement along the length of the cassette, towards and away from shutter 22. The locking plate 31, which may for example be machined from metal, is abutted by lever 32 at its inboard end which, when rotated in a clockwise direction by handle 50', acts on an end of the locking plate to slide it towards the shutter 22. The locking plate 31 is urged against the lever 32 by a resilient member such as a compression spring (not visible).

The locking plate 31 has a recess (which in this example extends through the thickness of the locking plate), which includes a cam surface 31*a*. The cam surface includes a ramp section of increasing height away from the shutter 22 and a notch at increased height at the end of the of cam surface furthest from shutter 22.

A stop element in the form of plunger 33 is slideably mounted to the wall 13 perpendicularly to the slide direction of locking plate 31. The plunger 33 couples with locking plate 31 via a cam follower in the form of a pin 33*a*, which rests on cam surface 31*a*. The plunger 33 is urged downwards such that the pin 33*a* abuts cam surface 31*a* by a resilient means in the form of a compression spring 33*b*.

A latch element 34 is pivotably mounted to the wall 13 between the shutter 22 and the locking plate 31. The latch member 34 is pivotable about an axis 35. At its uppermost end, the latch member includes a hook 34*a* which, in the position shown in FIG. 3, couples with a feature provided in lid 12 (not shown) to secure the lid 12 in a closed position. The latch member 34 is urged into this position by a resilient element in the form of a tension spring 34*b*.

Also pivotably mounted on axis 35 is a toothed gear wheel 37. The gear wheel 37 couples to shutter rack 38 which is provided on shutter 22 and to slide rack 36*a* provided on a slide element 36. The slide element 36 is shown in more detail in FIG. 3*a* and is positioned adjacent to the wall 13 which constrains it to slide along its length (towards and away from the shutter). The gear wheel meshes with rack gear 36*a* provided on slide element 36 and with the shutter rack 38 in such a way that movement of one results in movement of the other.

When the locking plate 31 is in the closed position shown in FIG. 3, the stop element 33 rests in its lowermost position, urged downward by spring 33*b* and supported by pin 33*a* at the lowermost point of cam surface 31*a*. In this position, the lowermost extremity of the stop member 33 prevents any sliding motion of slide element 36 by extending downwardly into its path. It is therefore not possible to open the shutter 22 in this configuration.

Turning to FIG. 4, clockwise movement of the lever 32 using the handle 50' moves the locking plate 31 to the left, as viewed in FIG. 4, against the force of the resilient element (not visible) which urges the locking plate 31 towards lever 32. This movement causes the pin 33*a* on stop element 33 to be carried up the cam surface 31*a*, which lifts the stop member 33 against spring 33*b*. This movement is continued until the pin 33*a* drops into the notch provided in cam surface 31*a* at which point the locking mechanism is in a "primed" condition.

With the stop member in this raised position, its lower extremity is aligned with a first cam surface 36*b* on slide element 36 in the form of a ramp. Should an attempt now be made to slide the slide element 36 to the right as shown in FIG. 4, the cam surface 36*a* will contact the lower extremity of locking member 33 and cause it to rise up, allowing the slide element 36 to move past, and so opening the shutter 22 via gear wheel 37. As will be described below, this movement is actuated by insertion of the cassette 10 into store housing 100.

Assuming for the time being that the cassette is not presently to be inserted into a store housing, from the primed position, turning the handle further in the clockwise direction moves locking plate 31 further to the left as viewed in FIG. 5. During this motion, a protrusion provided on locking plate 31 contacts the latch member 34 and causes it to rotate in an anticlockwise direction by a small amount. In doing so, the hook 34*a* moves out of engagement with the lid 12 (not shown), against the resilient force of spring 34*b*. The user is now free to open lid 12 and so load or unload the cassette as necessary. It should be noted that in doing so, there is no need to open shutter 22, which remains closed throughout.

When the locking plate is moved to this open position, the stop member 33 remains at its raised position by virtue of pin 33*a* and cam 31*a*.

Once the cassette 10 has been loaded with banknotes, the lid 12 is closed and the lock mechanism returned to its primed positioned by turning lever 50 anticlockwise to return to the configuration shown in FIG. 4. The locking plate 31 returns to the primed position by virtue of the resilient element (not shown). Since the pin 33*a* of stop member 33 is retained in the primed position by the notch of can surface 31*a*, the lever 32 may be returned to its default position (shown in FIG. 3), in which it will no longer contact the locking plate 31 (since this is held in the primed position by pin 33*a*). Alternatively, in some cases it may be preferred to leave the lever 32 in the priming position as shown in FIG. 4 which has certain advantages which will become clear below.

The cassette is now ready to be inserted into a store housing provided in a sheet handling apparatus such as that shown in FIG. 1. The store housing 100 includes two probes, 102*a* and 102*b*, which, as the cassette 10 is inserted into the housing 100, extend through apertures 17*a* and 17*b* provided in the base 14 of the cassette 10. The two probes 102*a* and 102*b* are provided with recesses 104*a* and 104*b* for engagement with the slide member 36 (and its counterpart in lock mechanism 30*a*, if provided). The slide element 36 is provided with means for coupling to the probes 102*a* and 102*b* in a manner which causes sliding of the slide element both as the cassette is inserted into the housing and as it is withdrawn. Suitable connection means are disclosed for example in EP-A-0263679. With the locking mechanism in the primed position, when the slide element 36 is pushed to the right (as viewed in FIG. 4) by the probes 102*a* and 102*b*, the first cam surface on the slide element 36 causes the lower end of the stop member 33 to rise up, disengaging the pin 33*a* from the notch in cam surface 31*a*. This disengagement will allow the locking member 31 to return to its original position as shown in FIG. 6. Movement of the slide element 36 continues until it reaches a stop provided by wall 13, during which motion, gear wheel 37 is rotated so as to withdraw shutter 22, revealing aperture 20 and allowing dispensing of banknotes.

The slide element 31 is further provided with a second cam surface 36*c* which is spaced from the first cam surface 33*b* along the slide direction. As the slide element moves, the second cam surface 36*c* comes into contact with a protrusion 34*c* (see FIGS. 4 and 5) provided on latch member 34 at the opposite end to hook 34*a*. The cam surface 36*c* causes anticlockwise rotation of the latch member 34, disengaging the hook 34*a* from the lid 12. This allows the lid 12 to be opened inside the store housing by appropriate means such as boss 15 and slots 110.

While the cassette 10 remains in the cassette housing 100, the stop member 33 stays in its present position, resting on top of slide 36. When the cassette is withdrawn, the probes 102*a* and 102*b* will draw the slide 36 back to its initial position so that the lower end of the stop member 33 will ride back across the cam surface 36*b* and then drop down to its original position as shown in FIG. 3. In this position it will no longer be possible for a probe to push the slides 36 since the end of stop member 33 now extends lower than can surface 36*b*. This prevents the cassette 10 from being reinserted into the store housing. This is termed "single-shot" use and its purpose is to increase security by preventing a cassette being reopened once it has been removed from a sheet handling device. The cassette can only be reopened once the locking mechanism has been re-primed by turning the handle 50'. In order to prevent priming taking place indiscriminately, the handle 50' may in practice be secured by a tamper seal 51 which must be broken in order to re-prime the locking mechanism. An example of a suitable seal is shown in FIG. 7(*i*), in which the seal 51 is connected between the handle 50' and the cassette 10' with the handle in the "default" position. Alternatively, as depicted in FIG. 7, the handle 50' may be replaced by a key operated lock cam and barrel 50 such that the cassette can only be primed by a person with access to the appropriate key. In this case, a conventional key can only be removed (and so the cassette inserted into the store housing) when the actuator is returned after priming to its "default" position.

However, in some implementations it is appropriate to allow for "multi-shot" use in which the cassette can be reinserted into a store housing multiple times. For example, in a secure environment it may be preferable to enhance the convenience of the cassette by allowing the cassette to be reinserted without the need for re-priming. In such cases, the lever 32 will be left in its priming position (as shown in FIG. 4) when the cassette is inserted into the housing. With the locking mechanism in the primed position, the shutter mechanism is free to open as described above but, since the locking 31 is constrained laterally by the lever 32, it does not return to the closed position despite the movement of pin 33*a* caused by the first cam surface 36*b* on slide element 36. Thus, when the cassette is removed from the store housing and the slide 36 returns to its original position, the stop element 33 comes to rest with the pin 33*a* again in the notch provided by cam surface 31*a*, such that the mechanism remains primed for reinsertion. To allow for such use, either a handle is used to actuate lever 32 as shown in FIG. 4 and FIG. 8(*ii*), or a suitable key operated lock cam and barrel 50" which allows for removal of the key whilst the lever 32 is left in the priming position, may be selected. FIG. 9 shows a third example of a suitable cassette which has been adapted in this way, and FIG. 10 shows the corresponding third embodiment of lock mechanism 30.

However, a particularly advantageous locking system will now be described with reference to FIGS. 11 and 12. FIG. 11 shows a conventional tubular key operated lock barrel 50 in combination with a conventional tubular key 100, as described above with reference to the first embodiment and depicted in FIGS. 1 and 7. As already described, a conventional key 100 (comprising key bow 101, key shank 102, circumferential cuts 103, retaining nib 105 and shoulder 106)

can only be removed from the conventional key-operated lock barrel 50 when It is in the same rotational position as that in which it was inserted. This is shown in FIGS. 11*b*) and *c*). In FIG. 11 *b*), the key 100 is inserted into the keyway 51 of lock barrel 50 with the retaining nib 105 aligned with recess 52, provided adjacent keyway 51. The key thus engages the lock mechanism and can be turned from the starting position (i) to a second rotational position (ii) (e.g. corresponding to the priming position described above). However, in position (ii), the key 100 cannot be removed from the keyway 51, because nib 105 is no longer aligned with recess 52 and so its passage is obstructed by retaining means within the conventional lock 50, as shown in FIG. 11*c*.

FIG. 12 shows an improved locking system in which the conventional lock 50 (identical to that depicted in FIG. 11) is paired with a specially adapted key 110. Like the conventional key, the key 110 comprises a key bow 111, a tubular shank 112, circumferential cuts 113 and a shoulder 116. However, the shank is not provided with any retention nib, as indicated at 115, such that the shank does not extend radially beyond the radius of the keyway 51 (the shoulder 116 does not form part of the shank since it is never inserted into the key barrel, but rather abuts the surface of the key barrel as shown in FIG. 11*c*, to stop the key being inserted too far into the lock).

The absence of a nib enables the key 110 to be inserted and removed from the conventional lock barrel 50 at any rotational position of the lock. As shown in FIG. 12*b*, the key 110 is aligned with the lock using the shoulder 116 as a guide (or simply inserting the key into the keyway 51 and rotating it until the cuts 113 engage with the lock mechanism) at a first position (i). The key is then turned, rotating the lock to position (ii). Here, the key can be removed as shown in FIG. 11*c*, leaving the lock in position (ii). The key can later be reinserted with the lock in position (ii) if desired. Alternatively, if the cassette is to permanently remain as a 'multi shot' (convenience) product, the key 110 may simply be disposed of. This arrangement makes it possible to use an entirely conventional lock barrel 50 in the cassette, the choice of key determining whether it will be used as a 'single shot' or 'multi shot' device. As such, a single version of the cassette need be produced to satisfy both markets.

It should be noted that the use of an actuator which can be fixed in either the "default" or "priming" positions in these various ways can advantageously be implemented with or without the above-described lid-locking mechanism. For example, the actuator could be used in combination with a locking plate moveable between just two positions corresponding to the closed and primed positions described above.

Further, the use of a handle for operation of the actuator in combination with a tamper seal can be implemented with any sort of locking mechanism, with or without the above-described lid-locking mechanism or two-position actuator.

The use of a seal offers a number of advantages. In the "single shot" configuration, the lock mechanism cannot be re-primed after the cassette is withdrawn from the store housing without removing the seal. Preferably, each seal is provided with a unique number or other code so that, should one seal be replaced by another, this will be identified. Such an arrangements offers traceability since the distribution of the tamper seals will typically be securely controlled and records kept of the ID codes in distribution. Thus if a cassette is tampered with, the persons responsible can readily be traced. This is not the case where a key-operated lock is used (without a seal) since persons having access to a suitable key could re-prime the lock mechanism without trace.

Similarly, the use of a seal in combination with the actuator in the "priming" position offers secure "multi shot" operation.

In these examples, as shown in FIG. 1, the cassettes include a second opening 24 closed by cover 26, although in other examples, this may be omitted. Where it is provided, the cover 26 is mounted in slides in the lid 12 and, on entry into the store housing contacts pushers 106 and 108 which slide the cover open to reveal aperture 24. The cover 26 may be locked in its closed position as described in EP-A-0263680.

As mentioned above, in some examples a second locking mechanism 30*a* may be provided in the opposite side wall of the cassette. However, in this embodiment it is sufficient to use the locking plate 31 to effect locking on both sides and, therefore, only certain components are disposed in the opposite side wall. In order to secure the lid 12 at a second point, a second latch member 44 (just visible in FIGS. 4 and 5) is pivotably mounted to the opposing internal side wall and is joined to the first latch member 34 for movement therewith. In the present embodiment this is achieved using a pin 41*b* which connects the lowermost extremity of the latch member 34 to an arm 42*b* (identical to component 42*a* shown in FIG. 3) which is joined to an identical arm 42*a* via shaft 40 which extends through the base of the cassette 10. The arm 42*a* connects to second latch member 44 through pin 41*a* such that the second latch member 44 is caused to rotate simultaneously with the first latch member 34. The second latch member 44 includes a hook which connects to a second feature provided in the lid (not shown).

For ease of use, the cassette may also include a window 55 (see FIG. 1) in the cassette base 14 through which is visible a flag 39 provided on locking plate 31. The flag indicates to the user through window 55 the position of the locking plate 31. For example when the locking plate 31 is in the closed position as shown in FIG. 3, the flag may display a red portion through window 55, whereas when this is moved to the prime position shown in FIG. 4, a green portion may be visible.

The invention claimed is:

1. A lock mechanism for a sheet store adapted for dispensing or accepting of sheets, the sheet store comprising a container having a lid openable for access to an interior of the container, and a shutter openable for passage of the sheets therethrough, wherein the lock mechanism comprises a lid lock element, a shutter lock element, a locking plate and an actuator for controlling movement of the locking plate, wherein the locking plate is slideably mounted on a wall of the container and is operable to control the lid lock element and the shutter lock element and is movable between three positions, including a closed position in which the shutter lock element prevents opening of the shutter, a primed position in which the shutter can be opened and an open position which controls the lid lock element to permit opening of the lid.

2. A lock mechanism as claimed in claim 1, wherein the lid lock element is pivotally mounted relative to the container and incorporates a hook for engagement with a feature provided on the lid.

3. A lock mechanism as claimed in claim 2, wherein the lock mechanism includes a first resilient element for urging the lid lock element towards a locked position.

4. A lock mechanism as claimed in claim 1, wherein the shutter lock element is moveable between a locked position in which opening of the shutter is prevented and an unlocked position in which the shutter can be opened.

5. A lock mechanism as claimed in claim 4, wherein the shutter lock element comprises a plunger slideably mounted relative to the container and movable in a direction perpendicular to that of the locking plate.

6. A lock mechanism as claimed in claim 4, wherein a cam follower arrangement is provided for coupling movement of the locking plate to the plunger.

7. A lock mechanism as claimed in claim 5, wherein the locking mechanism comprises a second resilient member for urging the plunger towards its locked position.

8. A lock mechanism as claimed in claim 6, wherein the locking mechanism comprises a second resilient member for urging the plunger towards its locked position.

9. A lock mechanism as claimed in claim 1, wherein the actuator comprises a lever operable to move the locking the plate between the closed, primed and open positions.

10. A lock mechanism as claimed in claim 1, wherein the actuator comprises a key-operated lock barrel operable to be rotated between a plurality of positions, such that a key can be inserted into, engage with and be withdrawn from the key-operated lock barrel regardless of a position of the key-operated lock barrel.

11. A lock mechanism as claimed in claim 1, wherein the lock mechanism includes a tamper seal for securing the actuator.

* * * * *